US012397887B1

(12) United States Patent
Tate et al.

(10) Patent No.: US 12,397,887 B1
(45) Date of Patent: Aug. 26, 2025

(54) SYSTEM AND METHODS FOR WAKE SURFING ZONE LOCATION IDENTIFICATION

(71) Applicant: Brunswick Corporation, Mettawa, IL (US)

(72) Inventors: Brandon L. Tate, Walnut Hill, IL (US); Trevor George, Savoy, IL (US)

(73) Assignee: Brunswick Corporation, Mettawa, IL (US)

( * ) Notice: Subject to any disclaimer, the term of this patent is extended or adjusted under 35 U.S.C. 154(b) by 135 days.

(21) Appl. No.: 18/298,506

(22) Filed: Apr. 11, 2023

(51) Int. Cl.
*B63B 79/40* (2020.01)
*B63B 49/00* (2006.01)

(52) U.S. Cl.
CPC ..... *B63B 49/00* (2013.01); *B63B 79/40* (2020.01); *B63B 2213/02* (2013.01)

(58) Field of Classification Search
CPC ..... B63B 49/00; B63B 79/40; B63B 2213/02
See application file for complete search history.

(56) References Cited

U.S. PATENT DOCUMENTS

| | | | | |
|---|---|---|---|---|
| 7,389,735 | B2 * | 6/2008 | Kaji | B63B 21/00 114/230.1 |
| 7,883,292 | B2 * | 2/2011 | Thompson | B63B 21/66 405/173 |
| 8,701,718 | B1 * | 4/2014 | Turiello | G08B 21/18 141/2 |
| 8,944,865 | B1 * | 2/2015 | Krabacher | B63H 21/21 440/1 |
| 10,793,245 | B1 * | 10/2020 | Trotter | G08B 7/06 |
| 11,254,402 | B1 | 2/2022 | Poirier et al. | |
| 11,260,946 | B1 | 3/2022 | Przybyl et al. | |
| 11,370,508 | B1 * | 6/2022 | Dugger | B63B 1/30 |
| 11,518,482 | B1 * | 12/2022 | Dugger | B63B 1/285 |
| 11,851,136 | B2 * | 12/2023 | Dugger | B63B 1/26 |
| 12,139,236 | B1 * | 11/2024 | Dugger | B63B 34/75 |
| 2010/0054078 | A1 * | 3/2010 | Thompson | B63B 35/04 367/20 |
| 2020/0363798 | A1 * | 11/2020 | Harnett | B63G 8/001 |

OTHER PUBLICATIONS

Freeberg et al., Fisheries enforcement through vessel localization using AVHRR and SAR technology, 1994, IEEE, p. 313-318 (Year: 1994).*

Roghers, Preventing recreational boating fatalities and serious injuries with: The ANN (Assistant Naval Navigator) System Enterprise, 2014, IEEE, p. 1-7 (Year: 2014).*

Goss, A real time particle system for display of ship wakes, 1990, IEEE, p. 30-35 (Year: 1990).*

Prasad et al., Video Processing From Electro-Optical Sensors for Object Detection and Tracking in a Maritime Environment: A Survey, 2017, IEEE, p. 1993-2016 (Year: 2017).*

* cited by examiner

*Primary Examiner* — McDieunel Marc
(74) *Attorney, Agent, or Firm* — Andrus Intellectual Property Law, LLP

(57) ABSTRACT

A system for displaying wake surfing locations for a marine vessel includes a memory storing a database of wake surfing rules indexed based on location identifications, a location identification system configured to identify a location of the marine vessel, a display device, and a control system. The control system is configured to identify applicable rules regarding wake surfing based on the location of the marine vessel and identify a surfable area where wake surfing is permitted on a body of water based on the applicable rules. A surfable area display is then generated representing the surfable area on a display.

22 Claims, 8 Drawing Sheets

SYSTEM AND METHODS FOR WAKE SURFING ZONE LOCATION IDENTIFICATION

FIELD

The present disclosure relates to marine vessels, and more particularly to systems and methods for managing wake surfing, including identifying permitted zones for wake surfing.

BACKGROUND

The following U.S. Patents provide background information and are incorporated herein by reference, in entirety;

U.S. Pat. No. 11,254,402 discloses a method of controlling propulsion for automated launch control that includes receiving a user-selected command associated with wake surfing, accessing a predetermined RPM limit associated with the user-selected command, and automatically increasing rotational speed of a powerhead to accelerate the marine vessel to a vessel speed setpoint such that the rotational speed does not exceed the predetermined RPM limit. Once the marine vessel is traveling at the vessel speed setpoint, a cruising RPM value associated with the vessel speed setpoint is identified. A difference between the predetermined RPM limit and the cruising RPM value is determined, and then the predetermined RPM limit is adjusted to an adapted RPM limit based on the difference. The adapted RPM limit is then stored for use during a subsequent launch.

U.S. Pat. No. 11,260,946 discloses a method of automatically controlling trim position of a marine drive via a control system on a marine vessel that includes receiving a user-selected command associated with wake surfing and then controlling a trim actuator to automatically position the marine drive in a tucked position, tucked position is between a vertical trim position and a minimum running trim position. Once a vessel condition of the marine vessel reaches a first threshold vessel condition the trim actuator is controlled to trim up the marine drive to a predetermined target trim position to generate wave behind the marine vessel. The first threshold vessel condition is at least one of a threshold vessel speed, a threshold engine speed, a threshold engine load, and a threshold vessel pitch.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In one embodiment, a system for displaying wake surfing locations for a marine vessel includes a memory storing a database of wake surfing rules indexed based on location identifications, a location identification system configured to identify a location of the marine vessel, a display device, and a control system. The control system is configured to identify applicable rules regarding wake surfing based on the location of the marine vessel and identify a surfable area where wake surfing is permitted on a body of water based on the applicable rules. A surfable area display is then generated representing the surfable area on a display.

In another embodiment, a method identifying wake surfing locations includes receiving a location identification, identifying applicable rules regarding wake surfing based on the location identification, and identifying a surfable area where wake surfing is permitted on a body of water based on the applicable rules. A surfable area display is generated representing the surfable area on a display.

Various other features, objects, and advantages of the invention will be made apparent from the following description taken together with the drawings.

BRIEF DESCRIPTION OF THE DRAWINGS

The accompanying drawings that are incorporated in and constitute a part of this specification illustrate several embodiments of the disclosure and, together with the description, serve to explain the principles of the disclosure. The present disclosure is described with reference to the following figures.

DETAILED DESCRIPTION

Figure 1:
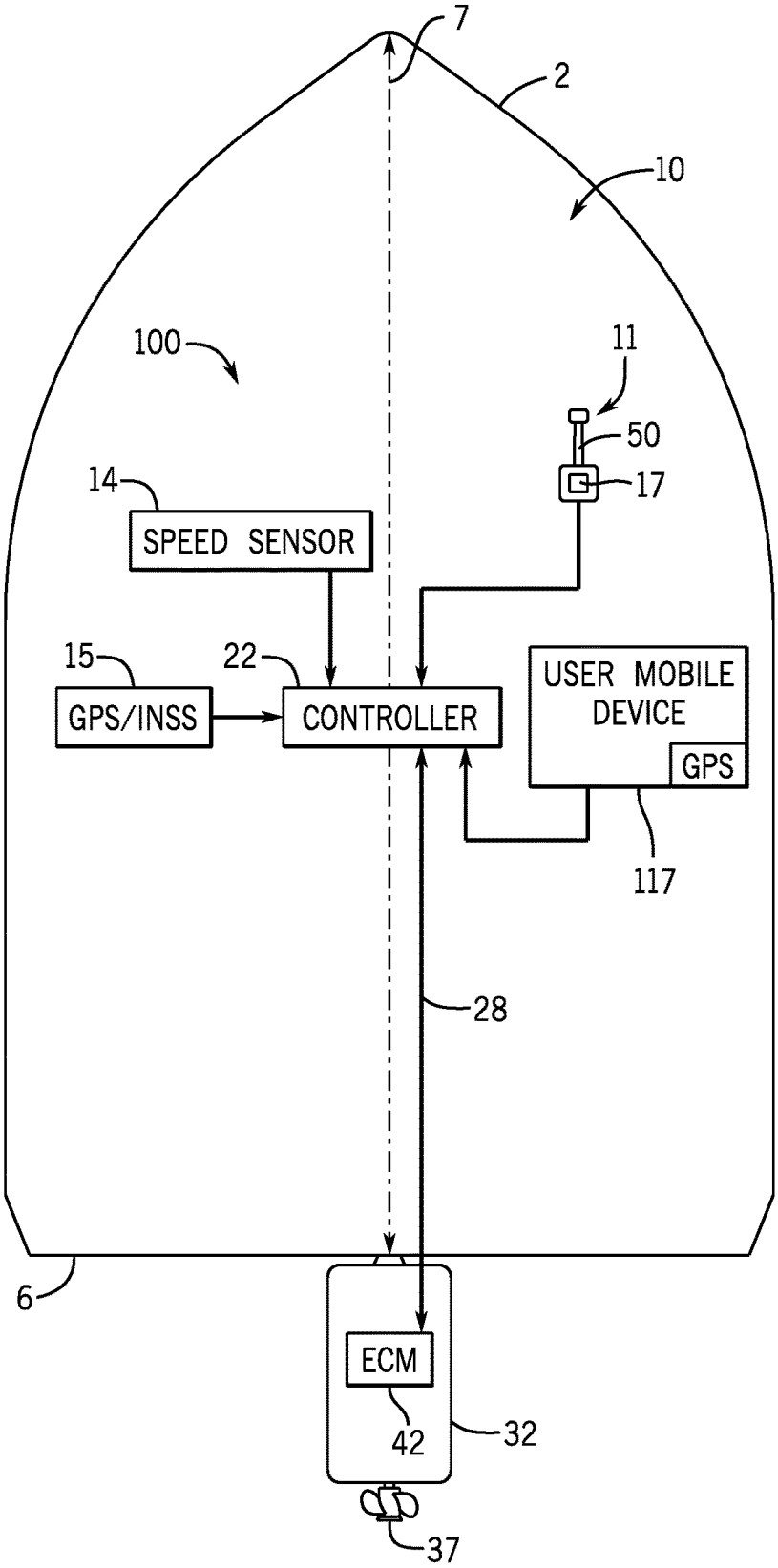
FIG. 1 depicts a marine vessel equipped with a propulsion system for wake surfing and a wake surfing location system according to an embodiment of the present disclosure.

The inventors have recognized that a plurality of laws, ordinances, and other rules are being put in place to restrict wake surfing activities, such as banning wake surfing within a certain distance from shore, banning wake surfing in certain bodies of water (e.g., in bodies of water below a certain acreage or depth, or with delicate shorelines. These ordinances are instituted because the wave generated when wake surfing is of such size and persistence that it may cause problems when too close to the shore, such as eroding the shoreline and vegetation or causing damage to boats and docks. The objective of these ordinances is typically to define how much open water a surfable wave needs to avoid negatively impacting the environment surrounding the marine vessel. These rules are sometimes noticed on physical signs located in or on the shores of specific bodies of water they pertain to, such as at boat launch sites. However, these rules often vary by location, such as based on the federal, state, and/or local laws that apply. Examples of rules around wake surfing may pertain to hours of the day in which wake surfing is permitted, times of the year in which wake surfing is permissible, as well as water depth, acreage, and/or distance from shore requirements previously mentioned.

Regarding distance from shore restrictions, the inventors have realized that it is often difficult to accurately ascertain and maintain a specific distance from a shore by visual observation and estimation. Additionally, it is often difficult for a user to focus on maintaining a fixed minimum distance from shore while also paying attention to other attentive requirements that occur while navigating a marine vessel. The same is true for complying with minimum depth requirements around wake surfing. These other observational obligations may include ensuring the safety of other passengers on the marine vessel as well as the safety of people proximal to the marine vessel, such as people being pulled behind the marine vessel on a wakeboard or tow rope.

Through their experimentation, research, and experience in the relevant field, the inventors have recognized that methods and systems are needed to assist users in identifying and tracking current wake surfing rules, and further that method and systems are needed that assist users in visualizing a surfable area of a given body of water and/or for determining whether a vessel in use for wake surfing is complying with the applicable rules. As disclosed herein, exemplary systems and methods include a database that provides relevant statutory, regulatory, and other wake surfing rules and information for a body of water in question. This database may include information, such as a list of rules, stored in association with each body of water to which the rule applies.

The disclosed systems and methods are configured to automatically identify applicable rules regarding wake surfing, such as based on a vessel location or a user's current location or based on a user input (such as identification of a body of water). Based on the applicable rules, a surfable area on a body of water is identified, which is an area where wake surfing is permitted. The system then generates guidance to a user regarding the surfable area. For example, the system may be configured to generate a surfable area display that visually depicts a surfable area of a body of water, such as one or more surfable area images generated based on location information and indicating surfability of a body of water or a portion thereof. For example, the surfable area display may include an overlay with the relevant surfable area depicted on a map of a given body of water. Additionally, this wake surfing location system may help alleviate current violations of the statutes and regulations. In one embodiment, compliance notifications may alert the user when the marine vessel approaches a boundary between a surfable area and a restricted zone.

FIG. 1 illustrates a marine vessel 2 having a propulsion system 10 for controlling propulsion according to the present disclosure. The propulsion system 10 includes at least one marine drive 32, and in some embodiments may include a plurality of marine drives configured and controlled as described herein. In the depicted embodiments, the marine drive 32 is an outboard drive, or outboard motor, coupled to the transom 6 of the marine vessel 2. The marine drive 32 may be an electric marine drive containing an electric motor or a combustion-powered device containing an internal combustion engine. Here, the marine drive 32 steerable and is thus attached to the marine vessel 2 such that it is rotatable about a respective vertical steering axis to steer the marine vessel 2. In other embodiments, the marine drive 32 may not be steerable and instead steering may be effectuated using one or more rudders. Often, the marine drive is also rotatable about a horizontal trim axis to trim the marine drives up and down. In the examples shown and described, the marine drive 32 is an outboard drive; however, the concepts of the present disclosure are not limited for use with outboard drives and can be implemented with other types of marine drives, such as stern drives, inboard drives, etc.

Figure 2:
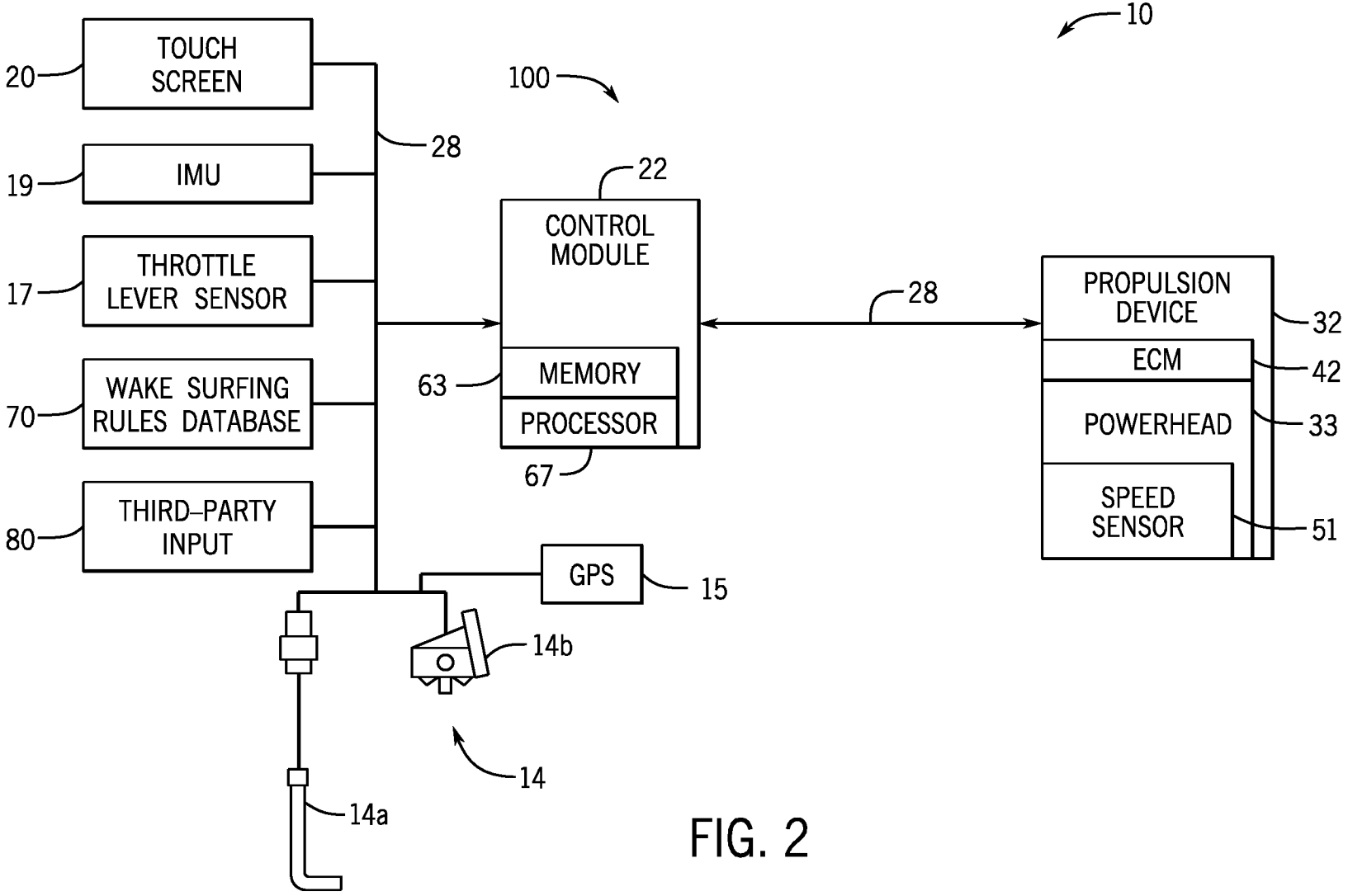
FIG. 2 is a schematic depicting another embodiment of a marine propulsion system and a wake surfing location system for a wake surfing vessel according to the present disclosure.

Referring also to FIG. 2, the marine drive 32 includes a powerhead 33, which is a prime mover and may include a motor (such as an electric motor), an engine (such as an internal combustion engine), or a hybrid thereof. Rotational speed, or RPM, of the powerhead (whether an ICE or an electric motor) is controlled to provide propulsion control, such as based on user input at a throttle lever, joystick, or other user input device. The powerhead initiates and maintains rotation of the drive shaft to thereby cause rotation of a propeller shaft having a propeller 37 at the end thereof, which will be understood as referring to a propeller or an impeller, or combination thereof. The propeller 37 is connected to and rotates with the propeller shaft propels the marine vessel 2. The direction of rotation of the propeller 37 is changeable by a gear system (e.g., a transmission), or in some embodiments by changing the directional rotation of the powerhead 33. The rotational direction of the propeller is typically controlled by a remote control 11 containing a throttle lever that can be moved by a user to control gear position and/or thrust direction and to provide a throttle input command associated with the respective marine drive 32. In a preferred embodiment, the remote control 11 is a drive-by-wire input device, and the position of the lever 50 sensed by the throttle position sensor 17 will be translated into a control input to the powerhead 33, such as to control the rotational speed or thrust thereof. Such drive-by-wire systems are known in the art, an example of which is disclosed at U.S. Pat. No. 9,103,287 incorporated herein by reference in its entirety.

The propulsion system 10 includes a control system 100 that includes one or more controllers and communication networks for effectuating propulsion control during surfing, which may be an automatic propulsion control routine autonomously executed by the control system 100 or may be based on user input. Each marine drive 32 may be associated with and controlled by a controller, illustrated here as an engine control module (ECM) 42, and a central controller 22, such as a helm control module (HCM) or command control module (CCM) communicatively connected to the ECM 42. As will be understood by an ordinary skilled person, in embodiments where the powerhead 33 is an electric motor or a hybrid electric motor, the ECM 42 will be configured accordingly. The connection between the HCM 22 and the ECM 42 is via a communication link 28, which may be by any known means and in various embodiments could be a CAN bus for the marine vessel (such as a CAN Kingdom network), a dedicated communication bus between the respective control modules 22 and 42, a wireless communication network via Bluetooth, BLE, ZigBee, or any other wireless protocol, or via other communication means implemented for facilitating communication between electronic devices on a marine vessel.

Thereby, communication is facilitated between the controllers in the control system 100, whereby the ECM communicates engine parameters—e.g., engine state (stall, crank, or run), RPM, throttle position, transmission speed, etc.—and the HCM 22 (or other central controller) can communicate control instructions—e.g. output commands based (such as based on user inputs to control throttle, steering, and/or trim) and/or output restrictions. The HCM 22 may further be configured to carry out propulsion and vessel speed control methods, such as automatic vessel speed or propulsion output control, such as via the methods and systems described in U.S. Pat. No. 11,254,402 incorporated herein by reference. The HCM 22 may receive and carry out propulsion, vessel speed control, and other instructions based on input submitted from a user mobile device 117. Applications on the user mobile device 117 may be configured to interface with the HCM 22. For example, the application for the mobile device 117 may interface with the surfable area display 130 via a vessel management system interface, such as VesselView Mobile™ provided by Mercury Marine.

The control system 100 arrangement depicted and described at FIGS. 1 and 2 is merely representative and various other arrangements are known and within the scope of the disclosure. For example, the control system 100 may further include additional or different controllers and/or controller types than those depicted, such as a powertrain control module (PCM) and/or a thrust vector module (TVM), as are well-known in the art. The methods described herein may be accomplished by any one controller or by cooperation of two more controllers within the control system 100 on the vessel 2.

Each of the controllers (HCMs, ECMs, etc.) may have a memory and a programmable processor, such as processor 67 and memory 63 in HCM 22. As is conventional, the processor 67 can be communicatively connected to a computer readable medium that includes volatile or nonvolatile memory upon which computer readable code (software) is stored. The processor 67 can access the computer readable code on the computer readable medium, and upon executing the code can send signals to carry out functions according to the methods described herein. Processor 67 can be implemented within a single device but can also be distributed across multiple processing devices or sub-systems that cooperate in executing program instructions. Examples include general purpose central processing units, application-specific processors, and logic devices, as well as any other type of processing device, combinations of processing devices, and/or variations thereof. In the example shown, at least one HCM 22 comprises a memory 63 (such as, for example, RAM or ROM), although all of the control modules may comprise such storage.

The controller 22 may receive powerhead speed, or RPM, from the ECM 42. The powerhead speed may be sensed by the engine speed sensor 51, as is well-known in the relevant art. The controller 22 may receive a vessel speed from vessel speed sensor 14. Alternatively or additionally, the control system 100 may receive input from a throttle lever sensor indicating throttle lever 50 position communicatively connected (e.g., via CAN bus 28) to one or more controllers 22. In the examples shown in FIGS. 1 and 2, the HCM 22 interprets these signals and sends commands to the ECMs. The vessel speed sensor 14 may be, for example, a pitot tube sensor 14*a*, a paddle wheel sensor 14*b*, or any other speed sensor appropriate for sensing the actual speed of the marine vessel. Alternatively or additionally, the vessel speed sensor 14 may be a GPS navigation sensor 15 that calculates vessel speed by determining how far the vessel has traveled in a given amount of time. In addition to speed determination, the HCM 22 may receive and interpret signals received from a navigation sensor 15, such as including a GPS navigation sensor 15, an Inertial Navigation System (INS), an inertial measurement unit (IMU), and/or other devices or systems providing position, orientation, and/or movement information. The navigation sensor transmits speed and/or location to the HCM 22, and may also transmit other information, such as heading and orientation information. For example, the IMU 19 senses a roll position, yaw position, and pitch of the vessel 2. For example, the IMU 19 may comprise a gyroscope, such as a three-axis gyroscope, to detect orientation information that may be used to determine the roll, yaw, and pitch angles of the marine vessel 2. In other embodiments, the IMU 19 may be a magnetometer, or may include any other type of position or inertial measurement unit, such as a combination accelerometer and/or gyroscope with a magnetometer.

The display device 20, such as a touchscreen display, or other user input device or system, can be used to receive user-selections and commands, including inputting a location for surfing and/or to select a wake surf mode. This may include user-selection of a launch control mode and relevant wake surfing speed, based on which propulsion output and vessel speed are automatically controlled. Such launch control modes are known for various tow sport applications, and wake surfing speed setpoints are generally between 8 and 15 mph, and often between 9 and 13 mph. Additional exemplary launch and speed control methods and modes of operation are described at U.S. Pat. Nos. 6,485,341, 7,214,110, 7,361,067, 10,343,758, which are incorporated herein by reference in their entireties. As is typical, the user may select launch control mode and may then make a subselection designating a particular launch behavior, such as to select wake surfing or to select a stored launch profile associated with wake surfing. Here, the system 100 may be configured such that one or more "wake surfing" launch profiles or and/or a "wake surfing launch control" mode is available. The display device 20 may comprise part of a user interface system at the vessel helm. In one embodiment, the display device 20 may comprise part of an on-board management system for the marine vessel 2, such as a VesselView® by Mercury Marine of Fond Du Lac, Wisconsin. In various embodiments, the display device 20 may be incorporated in a user interface system that further includes one or more input devices for facilitating user input, such as a keyboard, push buttons, etc.

Navigational and/or propulsion control settings of the system 100 may be supplemented by wake surfing rules, such as from the wake surfing rules database 70 and software for determining a surfable area and/or compliance with wake surfing rules. As discussed above, the wake surfing rules database 70 may be an aggregated index of relevant wake surf rules and regulations from various political and geographical jurisdictions covering many bodies of water. The wake surfing rules database 70 may be an indexed reference of various laws (federal, state), regulations, and/or other rules, such as indexed based on location, such as GPS coordinate ranges to which they apply, body of water names to which they apply, and/or political jurisdiction to which they apply (e.g., country, state, county, city, etc.). In one embodiment, the system received location identification, such as from a location identification system that includes the navigation sensor 15, thus enabling the control system 100 to retrieve the rules that are relevant to the body of water based on the current location identification, such as GPS location, of the vessel and/or a user.

In some embodiments, the control system 100 is configured to check for updates to relevant rules impacting where wake surfing can be performed, including federal, state, and local laws and ordinances, and/or configured to periodically download an updated version of the wake surfing rules database 70. For example, a wake surfing rules database 70 may be hosted at a remote location where it is maintained and regularly updated, and where it is made accessible by the control system 100 via cellular or other wireless communication means for periodic updates to a local copy stored in memory 63 of the control system 100. Alternatively, an updated version of the rules database 70 may be pushed out to subscribers by a centralized software maintenance system and received by the control system 100, such as via a connected vessel management software system such as the VesselView products suite provided by Mercury Marine.

In one embodiment, the surfable area display may include a timestamp indicating the last updated retrieval of the displayed ordinances and regulations so as to notify the user of the last updated version of the wake surfing rules database 70. Additional relevant data retrieval information, such as the source and date of the update, may also be included to distinguish between ordinances of different origins and/or versions, such as state laws or county ordinances. In embodiments, the system 100 may be configured to update the rules database 70 based on third party input 80, such as updates from third party publications or crowd-sourcing inputs that collect data on wake surfing rules or rule changes.

Figure 3:
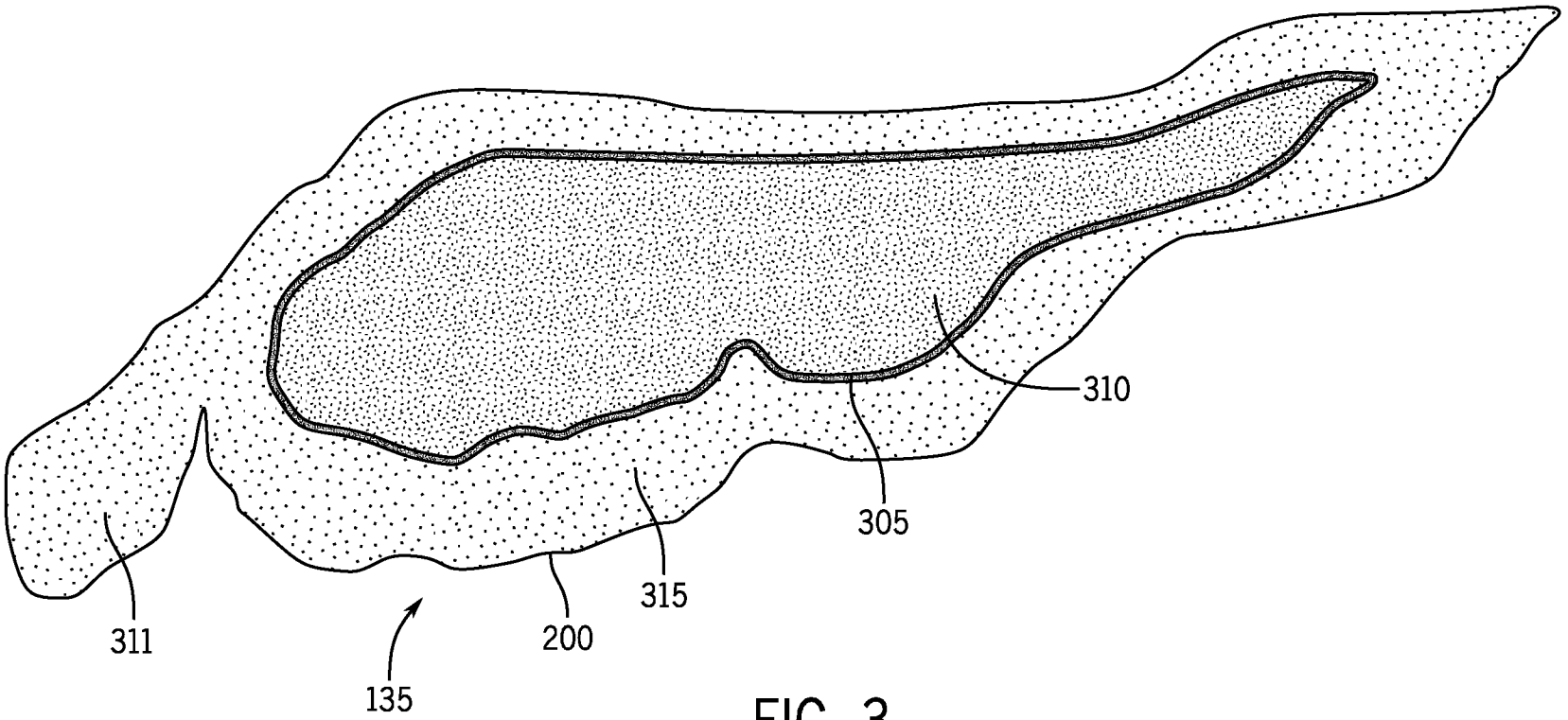
FIG. 3 depicts a schematic representation of a surfable area image in accordance with the present disclosure.

Wake surfing rules may include metrics that may be determined by the wake surfing location system, such as the size of the body of water, the distance between the marine vessel 2 creating the wake surfing wave and the shoreline, and the required depth of the body of water. Turning to FIG. 3, to calculate the shoreline and the distance from shoreline, the GPS navigation sensor 15 may be used by the control system 100 to determine a boundary 305 that establishes the required distance from the shoreline that comports with the identified applicable rule(s). The boundary 305 is the edge of the surfable area 310 of the body of water 200; to exceed the boundary 305 is to move into the restricted zone 315 which is deemed unfit for wake surfing.

Surfability of a body of water 200, such as a lake or a river, is then depicted on a surfable area display including one or more surfable area images. FIG. 3 depicts an exemplary surfable area image 135. The surfable area images 135 may be part of an interactive user interface, a visual overlay of relevant regulations situated in proximal vicinity to a location indicator (marked by vessel marker 115), or a static overlay depicting a surfable area on a map image showing some or all of a body of water 200. Namely, the control system 100 determines the surfable area of the body of water 200 by applying the relevant rules to the map data for the body of water 200, such as based on GPS map data indicating the shoreline and/or depth information for the body of water. In one embodiment, this surfable area image 135 may be generated that divide the body of water into zones, including one or more surfable areas 310 where wake surfing is permitted and one or more restricted zones where wake surfing is not permitted.

Figure 4:
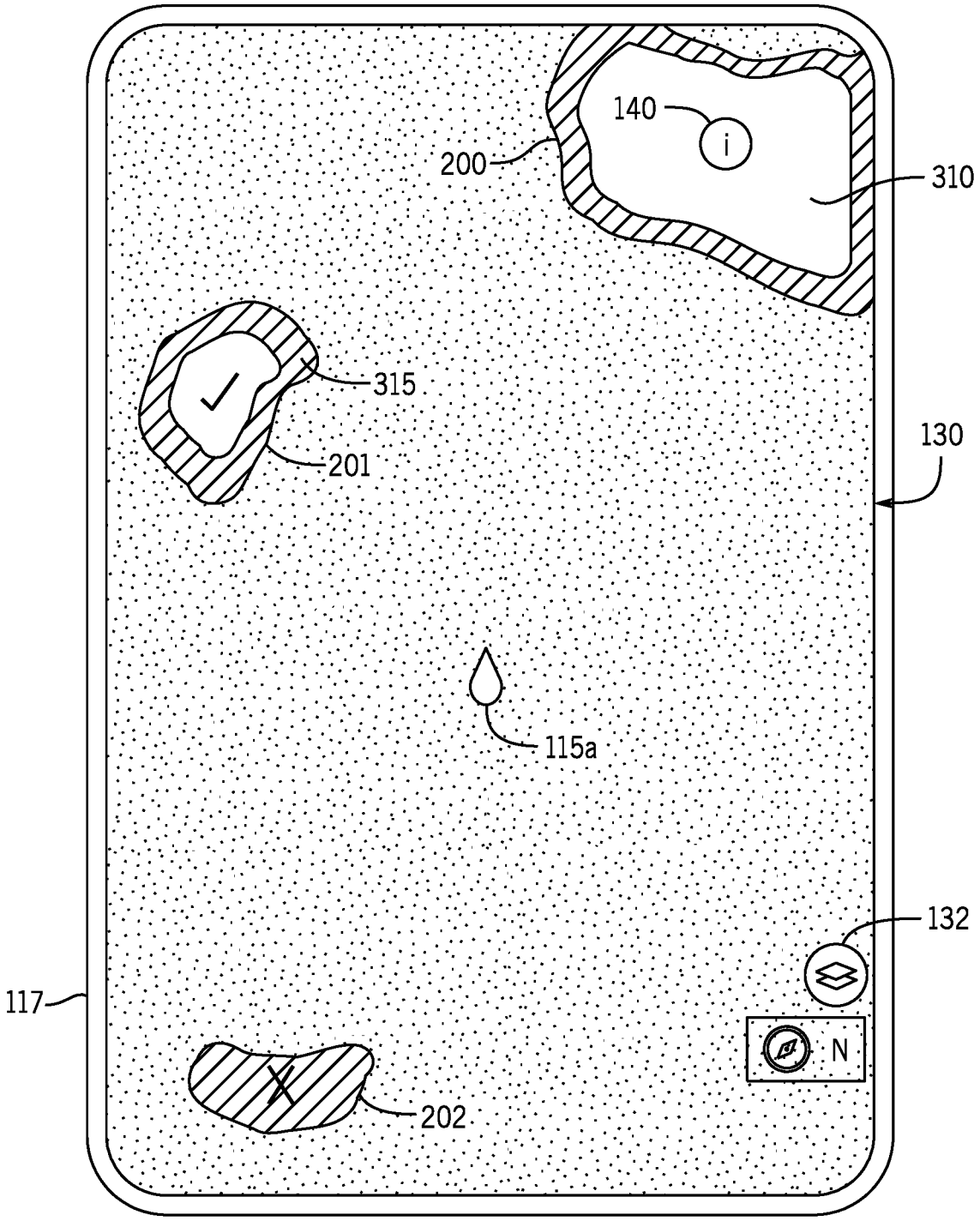
FIGS. 4 and 5 depict embodiments of an exemplary surfable area display on a display device in accordance with the present disclosure.
Figure 5:
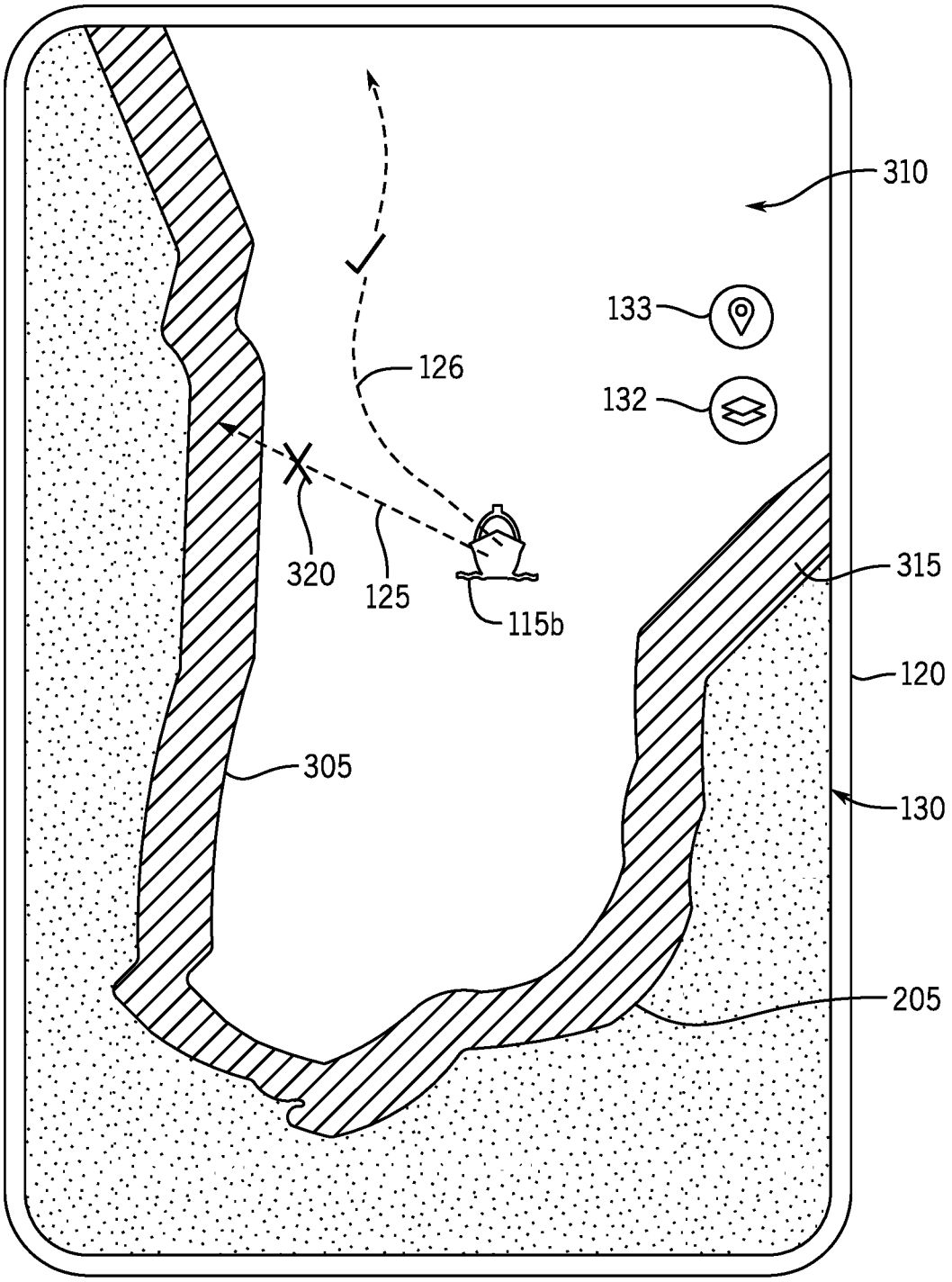

FIGS. 4 and 5 depict additional examples of surfable area displays that are discussed in more detail below. Restricted zones 315 indicate portions or regions of a body of water 200 where surfing is not permitted by the applicable rules regarding wake surfing that apply to the body of water 200, such as based on distance from shore requirements, depth requirements, or rules setting out areas where wake surfing is not permitted for other reasons, such as environmental reasons.

For example, the control system 100 may be configured to determine a set of GPS locations representing the surfable area, such as a set of GPS coordinates defining the surfable area boundary 305 surrounding the surfable area. Alternatively, the set of GPS locations representing the surfable area may include GPS locations for the entire surfable area, or otherwise demarcate or represent the range of GPS locations occupied by the surfable area 310 in the body of water 200. For instance, where an applicable rule is included that specifies a setback from shore, the control system may identify an inner boundary based on the GPS shoreline information, subtracting the setback from the shoreline. In certain embodiments, the system 100 may be configured to generate a smooth boundary 305 defining the surfable area 310, which will be easier to comply with while performing surfing activities. Thus, a jagged coastline or shoreline may be smoothed using mathematical approximations, such as by linear or polynomial regression, to form an approximate distance estimation from an uneven shoreline. However, where the smoothed boundary violates a setback rule, the entire smoothed boundary may be shifted such that all points on the boundary do not violate any applicable rule. This includes carveouts for depth restrictions or other restrictions. For example, the boundary may be adjusted to carve out areas where the GPS depth information for the body of water 200 does not comply with depth restrictions set forth in the applicable rules.

In some embodiments, a surfable percentage of the body of water is calculated based on the size of the surfable area 310 compared to the area of the body of water 200. In some embodiments, the surfable area display is further based on the surfable percentage, such as displaying a surfable area percentage value or visually indicating whether a body of water has at least a threshold surfable area percentage. The system 100 may be configured to require a minimum size of the surfable area and/or depth to qualify a zone as a surfable area 310, or to require a minimum percentage surfable area percentage. Similarly, the control system 100 may be configured to identify whether a potential surfable area 310 (e.g., meeting minimum setback and depth requirements) is inaccessible, such as not having a boat launch and enclosed by a restricted zone 315. The control system 100 may be configured to demarcate the otherwise surfable area as a restricted zone 315, or to otherwise visually indicate that the potentially surfable area is inaccessible.

The surfable area image 135 is then generated accordingly, where the boundary 305 and/or the surfable area 310 are visually depicted on an image of the body of water 200. Using the set of GPS coordinates defining the surfable area 310 and/or the boundary 305, a map of the body of water 200 may be overlayed with an area showing what section(s) are surfable.

The creation of the surfable area display may be performed by any computing device in the control system 100, such as the controller 22 or other computing device installed on the marine vessel or may be performed by the computing system of the user's mobile device 117. The surfable area display may also be displayed on display device 20 at the helm and/or displayed on the user's mobile device.

Compliance with the applicable rules by a marine vessel, or occupant thereon, may be determined using onboard sensors, including GPS, depth sensors, and/or heading or other directional sensor systems. Onboard sensors such as a GPS system, a depth sensor, or a navigation sensor 15, may provide quantitative values from which the control system 100 can make a quantitative comparison between the current position of the marine vessel 2 and the positional requirements determined by the regulations. In one embodiment, the navigation sensor 15 may provide the metrics used to compare the current position and location of the marine vessel with the compliance standards of the referenced regulations.

The control system 100 may utilize one of a plurality of potential sensors that produce the metrics measured by the navigation sensor 15. For example, the navigation sensor 15 may be a GPS device located on the marine vessel 2, an INS system native to the marine vessel 2, or a GPS device located on a user mobile device 117 as a non-limiting list of examples. Information provided by the navigation sensor 15 may allow the control system 100 to narrow existing regulations stored in the wake surfing rules database 70 to those applicable to a specific body of water 200. The rules are then interpreted with respect to the body of water 200, such as based on shoreline information and depth information for that body of water 200 (or a portion thereof), to identify what area(s) of the body of water permit wake surfing and are thus "surfable." The surfable area is then indicated to the user, such as by generating a surfable area display that visually depicts the surfable area of the body of water 200 (or portion thereof). FIG. 4 depicts an embodiment of an exemplary surfable area display 130 on a display device 120. In one embodiment, the location system may provide relevant regulations and surfability of at least one nearby body of water. In this scenario, the navigation sensor 15 used to provide relevant regulation information may be located in a mobile user device 117. The system 100 may be configured to locate relevant rules based on the current location of the user's mobile device (e.g., based on its GPS location detected via an internal GPS sensor). This configuration allows the wake surfing location system to identify rules and determine surfable areas in bodies of water 200, 201, 202 near a user's location (marked by location marker 115*a*).

As an illustrative example, a user may visit a region that is proximal to a number of lakes and other bodies of water 200, 201, 202. The location system may, by basing the information off the location provided by the user's mobile device 117 or a location otherwise selected or inputted by the user, provide information relevant to the bodies of water 200, 201, 202 proximal to the user.

This method of rule association with multiple bodies of water 200, 201, 202 may allow a user to decide where to go before discovering previously unknown regulations at the body of water 200. The surfable area display 130 may indicate that some bodies of water 202 are completely off-limits due to an insufficient size. Other bodies of water 201 may have an overlay that indicates how much of the body of water 201 is a surfable area 310.

Accordingly, the control system 100 checks for updates to relevant state and local ordinances. In one embodiment, the surfable area display may include a timestamp indicating the last updated retrieval of the displayed ordinances and regulations. Additional relevant data retrieval information, such as the source of the update, may also be included to distinguish between ordinances of different origins, such as state ordinances or county ordinances.

In one embodiment, rules in the database 70 may be updated based on third party input 80, such as updates from third party publications or crowd-sourcing inputs that collect data on wake surfing rules or rule changes. For example, third party inputs 80 may include web pages or postings on web pages from Department of Natural Resources (DNR) officers, locals who are familiar with the current status of the lake, relevant message boards, or the like. For example, the system for maintaining the wake surfing rules database 70 may be configured to obtain information from a message board or similar method of crowdsourcing information. In one embodiment, proposed updates to the wake surfing rules database 70 based on third party inputs 80 may require approval from an administrator. This collaborative portal may allow for feedback and observations to be submitted. User submissions may correct existing information regarding state and local ordinances or give feedback on the responsiveness of updates and indicate whether the updates need to occur more frequently. Submitted communal communication methods may also allow for notification of other types of restrictive events that may not be included in state and local ordinances such as a maintenance notification that restricts wake surfing on a body of water 200 because the body of water 200 has been drained to fix or maintain a dam connected to the body of water 200. Because these adjustments to state and local rules are normally observable only when user is physically at the body of water 200 (if observable at all), the disclosed system provides the benefit of increased awareness of not only regulations and other rules but also temporary changes and safety precautions that apply to the body of water 200.

Referring again to FIG. 4, the system may be configured to notify a user of updates to the wake surfing rules database 70 and/or note any relevant rule changes for a particular body of water 200. For example, the system may be configured to generate a notification 140 on the surfable area display 130 to provide the user with additional insight as to the present condition and rules of the body of water 200. Multiple notifications may be associated with a body of water 200 at the same time. For example, reports of changes to both the required minimum distance from shore and a change in seasonal times and dates for wake surfing on the body of water 200 may be submitted.

FIG. 5 depicts another embodiment of an exemplary surfable area display on a display device. The display device 120 for displaying the surfable area display 130 could be located at a helm of a marine vessel 2, such as display device 20, or on a user mobile device 117. As described herein, the control system 100 may be configured to monitor the location of the marine vessel and/or the user's mobile device and to assess compliance with the applicable wake surf rules in real time. The real-time comparison between the current location of marine vessel 2 and the surfable area 310 allows the user to determine whether they are adhering to the state and local wake surfing rules and that they are immediately notified if any rules are being violated.

The system 100 may be configured to generate a surf compliance notification notifying a user of their compliance status with the applicable surfing rules. For example, the system 100 may be configured to notify the user with a compliance notification indicating whether the user is complying or not complying with the applicable rules. The surfable image display 130 may indicate the surf compliance of a present position (as demarcated by a vessel marker 115*b*). For example, an icon or other compliance indicator may be displayed to indicate the compliance status, such as displaying the vessel marker 115*b* in a first color (e.g., green) to indicate compliance and in a second color (e.g., red) to indicate that the vessel outside of a surfable area.

The system 100 may further determine surf compliance and/or generate a surf compliance notification based on the vessel heading. The vessel's current heading 125 may be provided from, or determined based on information from, one or more of the INS, IMU and/or GPS. such as determined by input from the INS, IMU, GPS, or other vessel position, orientation, and/or heading sensor. In one embodiment, the surfable image display 130 may present a surfable area image 135 of the current marine vessel 2 oriented with the current heading direction and/or indicating the vessel's heading direction. This may assist the user in staying within a surfable area or navigating back into a surfable area when the control system 100 notifies the user that the marine vessel 2 is currently located in a restricted zone 315.

In certain embodiments, the system 100 may further be configured to generate a surf compliance warning based on a vessels location, speed, and/or current heading 125. The control system 100 compares the current heading 125 with the set of GPS locations representing the surfable area 310 of the body of water 200. When the marine vessel 2 comes within a threshold distance or a threshold time of exiting the surfable area, the wake surfing location system may generate a surf compliance warning to notify a user that they are nearing a boundary 305 of the surfable area. For example, the system 100 may be configured to generate a surf compliance warning whenever the vessel is within a threshold distance of the boundary 305. Alternatively, the system may be configured to generate a surf compliance warning when the vessel is within a threshold distance of the boundary calculated only in a heading direction 125 of the vessel. In still other examples, the system 100 may be configured to generate a surf compliance warning when, based on the vessel speed and heading, the vessel is within a threshold time of reaching the boundary 305.

In the example illustrated in FIG. 5, a compliance notification 320 is generated based on the current heading direction 125, and specifically based on the vessel being within a threshold distance or time of the boundary 305 of the surfable area 310 along the heading direction 125. In the depicted example, the system 100 is configured to provide a suggested path 126 from the vessel's current location that remains in the surfable area 310 of the body of water 200. The suggested path 126 may also be indicated on the surfable area display 130.

The surfable area display 130 may include at least one selection input 133, 132 to select a different surfable area display 130 or surfable area image 135. The selection input 132 may allow the user to switch between user interfaces that may provide different information to the user. As an example, the user may switch between a static surface area image 135 that presents an image of the body of water 200 and or a zoomed version thereof centered on the marine vessel's 2 current location, as indicated by a vessel marker 115*b*.

A surf compliance warning may include an audible or visual notice to the user of the marine vessel's 2 location status with respect to the surfable area 310. In one embodiment, the surf compliance warning may operate as a passive continuous violation indicator of the current state of the marine vessel's 2 position. For example, a small light may continually shine green to indicate that the real-time position of the marine vessel 2 is in the surfable area 310. However, as the marine vessel is within a threshold distance of the boundary 305 or edge of the surfable area 310, the light may switch to orange and/or begin to blink. As marine vessel 2 enters the restricted zone 315, the same light may flash red and/or begin to emit an audible warning that indicates to the user that they are in the restricted zone 315.

Figure 6:
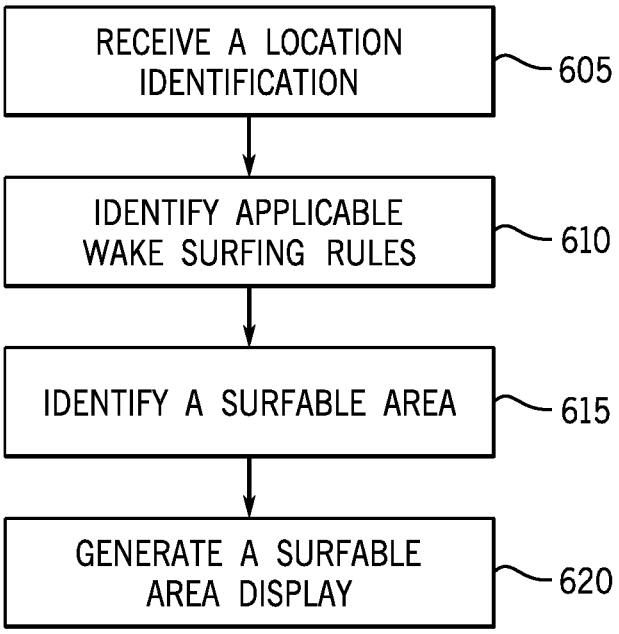
FIGS. 6, 7, and 8 outline exemplary method steps for a wake surfing system in accordance with the present disclosure.

Referring now to FIG. 6, exemplary method steps for a wake surfing location assessment are illustrated. At 605, a location identification is received, such as a GPS location based on a location of a marine vessel 2 (e.g., from GPS 15) or of a user's mobile device 117. Alternatively, the location identification may be the name of a body of water, address or zip code, or identification of a city or other geographically identifiable location. At 610, the system 100 identifies applicable wake surfing rules based on the location identification. These wake surfing rules are stored and accessed, such as from the wake surfing rules database 70. At 615, the system 100 identifies a surfable area in the body of water. Then, at 620, the system 100 generates a surfable area display. This surfable area display may contain one or more surfable area images of the relevant body of water.

Figure 7:
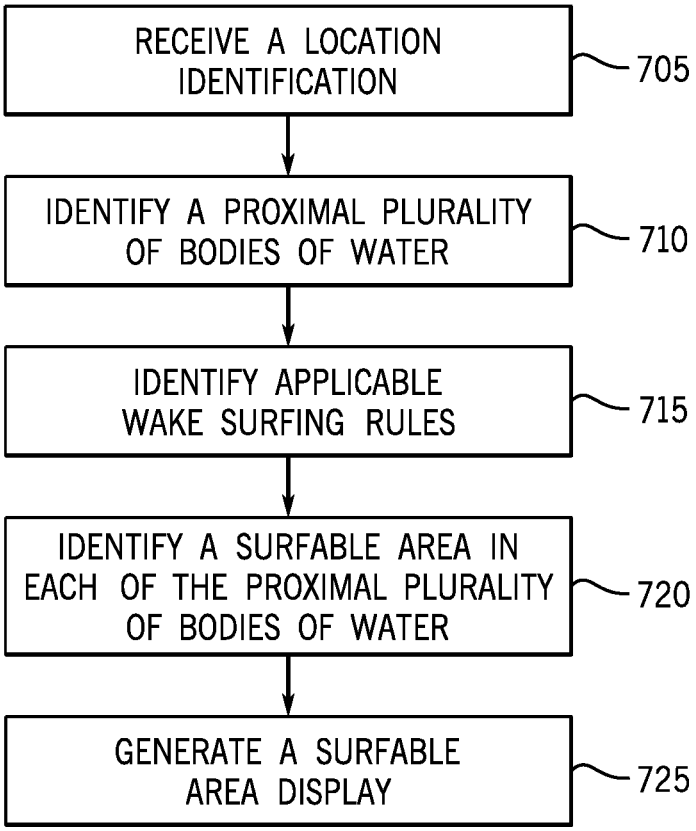

Referring now to FIG. 7, exemplary method steps for a wake surfing location assessment are illustrated. At 705, a location identification is received, as described above. At 710, the system 100 identifies a plurality of bodies of water in the vicinity of the location identification. At 715, the applicable wake surfing rules are identified, as described in detail above. At 720, the surfable area is identified in each of the proximal plurality of bodies of water. This may include an indication of little or no surfable area in one or more of the plurality of bodies of water. Then, at 725, the system 100 generates a surfable area display. As described herein, this surfable area display may include a location indicator that displays the current location of the user in relation to the proximal plurality of bodies of water.

Figure 8:
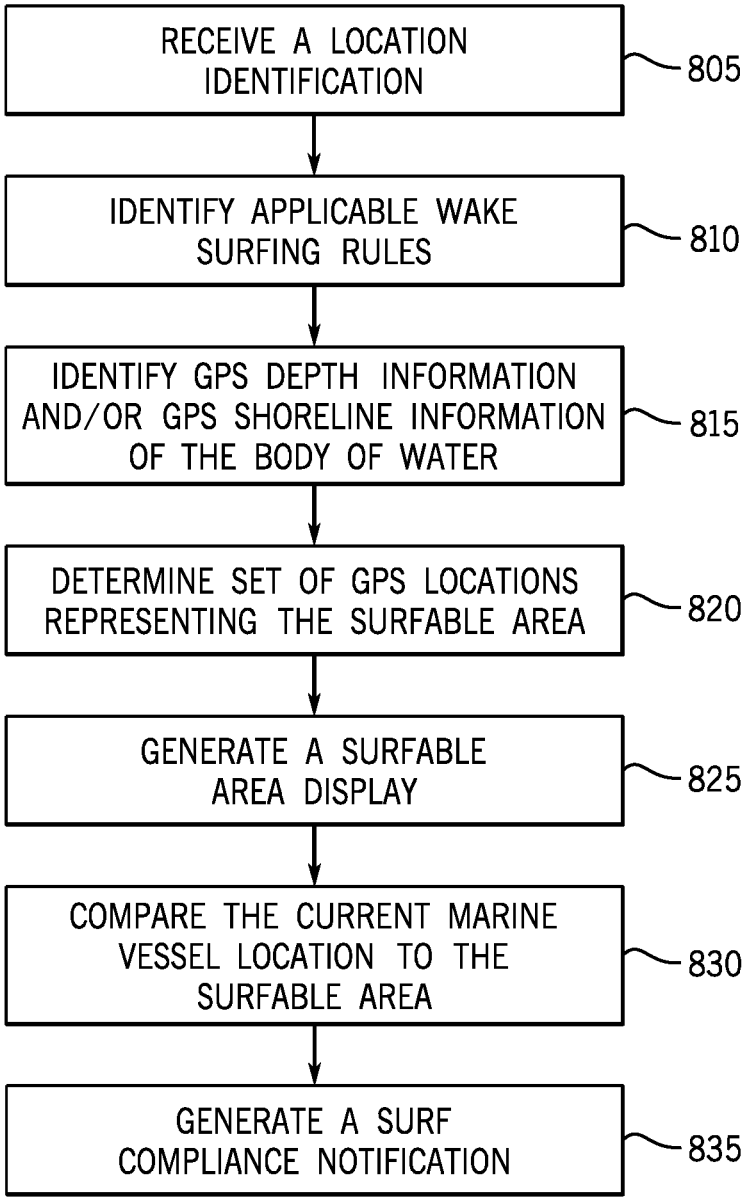

Referring now to FIG. 8, further exemplary method steps for a wake surfing location identification. In various embodiments, the disclosed real-time wake surf location assessment functions for a vessel may be initiated upon a user's instruction, such as to engage the surf compliance monitoring software and or to engage the real time monitoring function thereof. Alternatively or additionally, the disclosed real-time wake surf location assessment functions may automatically begin upon engagement of a surf mode or wake surf launch mode at the vessel helm (examples described above), or upon deployment of a wave generation appendage such as a surf tab, ballast, or the like. At 805, a location identification is received, as described above. At 810, applicable wake surfing rules are identified based on the location identification. At 815, the GPS depth information and/or GPS shoreline information of the identified body of water is identified. At 820, the surfable area of the body of water is determined by a set of GPS locations. At 825 system generates a surfable area display. This surfable area display may include a location indicator that displays the current location of the user and/or the marine vessel in relation to the surfable area. At 830, the current marine vessel location is compared to the surfable area of the body of water. At 835, a surf compliance notification is generated to alert the user to the position of the marine vessel in relation to the surfable area.

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A system for displaying wake surfing locations for a marine vessel, the system comprising:
- a memory storing a database of wake surfing rules indexed based on location identifications;
- a location identification system configured to identify a location of the marine vessel;
- a display device;
- a control system configured to:
  - based on the location of the marine vessel, identify applicable rules regarding wake surfing;
  - based on the applicable rules, identify a surfable area where wake surfing is permitted on a body of water; and
  - generate a surfable area display representing the surfable area on a display.

2. The system of claim 1, wherein the vessel location includes a current GPS location of the marine vessel, and wherein the control system is further configured to:
- display, on the surfable area display, the current GPS location with respect to the surfable area.

3. The system of claim 1, wherein the vessel location includes a current GPS location of the marine vessel, and wherein the control system is further configured to:

identify GPS depth information and/or GPS shoreline information of the body of water;

determine a set of GPS locations representing the surfable area based on the GPS depth information, the GPS shoreline information, and the applicable rules; and generate the surfable area display based on the set of GPS locations.

4. The system of claim 3, wherein the control system is further configured to generate a surfable area image demarcating the surfable area of at least a portion of the body of water based on the set of GPS locations and the GPS location of the marine vessel, and wherein the surfable area display contains the surfable area image.

5. The system of claim 1, wherein the vessel location includes a current GPS location of the marine vessel, and wherein the control system is further configured to:

identify a current vessel location within the body of water based on the location identification;

compare the current vessel location within the body of water to the surfable area; and generate a surf compliance notification on the display based on the comparison.

6. The system of claim 5, wherein the control system is further configured to:

determine whether the current vessel location is within the surfable area;

wherein the surf compliance notification is based on whether the current vessel location is within the surfable area.

7. The system of claim 5, wherein the control system is further configured to:

receive a vessel heading and/or a vessel speed and to determine, based on the current vessel location and at least one of the vessel heading and/or the vessel speed, that the marine vessel is within a threshold distance or a threshold time of exiting the surfable area;

wherein the surf compliance notification includes a surf compliance warning advising a user that they are near an edge of the surfable area.

8. The system of claim 1, wherein the control system is further configured to calculate a size of the surfable area based on an area of a body of water identified by the location identification and the applicable rules regarding permitted areas for wake surfing;

wherein the surfable area display is further based on the size of the surfable area.

9. The system of claim 8, wherein the control system is further configured to:

identify an area of the body of water;

calculate a surfable percentage of the body of water based on the size of the surfable area compared to the area of the body of water; and wherein the surfable area display is further based on the surfable percentage of the body of water.

10. The system of claim 1, wherein the wake surfing rules define permitted areas for wake surfing applicable to a body of water associated with a GPS location.

11. A method identifying wake surfing locations, the method comprising:

receiving a location identification;

based on the location identification, identifying applicable rules regarding wake surfing;

based on the applicable rules, identifying a surfable area where wake surfing is permitted on a body of water; and generating a surfable area display representing the surfable area on a display.

12. The method of claim 11, further comprising:

identifying a current vessel location comprising a GPS location of a marine vessel in the body of water based on the location identification; and displaying, on the surfable area display, the current vessel location with respect to the surfable area.

13. The method of claim 11, further comprising:

identifying a current vessel location of a marine vessel within the body of water based on the location identification;

comparing the current vessel location to the surfable area; and generating a compliance notification on the display based on the comparison.

14. The method of claim 13, further comprising:

determining whether the current vessel location is within the surfable area; and wherein the compliance notification is based on whether the current vessel location is within the surfable area.

15. The method of claim 14, further comprising:

determining, based on the current vessel location and at least one of a vessel heading and/or a vessel speed, that the marine vessel is within a threshold distance or a threshold time of exiting the surfable area;

wherein the compliance notification includes a surf compliance warning advising a user that they are near an edge of the surfable area.

16. The method of claim 11, wherein identifying the applicable rules regarding wake surfing includes accessing a database of wake surfing rules indexed based on location identifications, wherein the location identifications include at least one of GPS locations, body of water names, or political jurisdictions.

17. The method of claim 16, wherein the wake surfing rules define permitted areas for wake surfing applicable to a body of water associated with a GPS location.

18. The method of claim 11, wherein the location identification is a GPS location, and further comprising:

identifying GPS depth information and/or GPS shoreline information of the body of water;

determining a set of GPS locations representing the surfable area based on the GPS depth information, the GPS shoreline information, and the applicable rules; and generating the surfable area display based on the set of GPS locations.

19. The method of claim 18, wherein the GPS location is a GPS location of a marine vessel received from a GPS device on the marine vessel.

20. The method of claim 19, further comprising generating a surfable area image demarcating the surfable area of at least a portion of the body of water based on the set of GPS locations and the GPS location of the marine vessel, wherein the surfable area display contains the surfable area image.

21. The method of claim 11, further comprising:

calculating a size of the surfable area based on an area of a body of water identified by the location identification and the applicable rules regarding permitted areas for wake surfing;

wherein generating the display representing the surfable area includes representing the size of the surfable area.

22. The method of claim 21, further comprising:

calculating a surfable percentage of the body of water based on the size of the surfable area compared to the area of the body of water; and wherein generating the display representing the surfable area includes representing the surfable percentage of the body of water.

* * * * *